US005575687A

United States Patent [19]

Tsai

[11] Patent Number: 5,575,687

[45] Date of Patent: Nov. 19, 1996

[54] EDGE BOARD CONNECTOR

[76] Inventor: Chou-Hsuan Tsai, 4-4Fl, No. 8, Lane 609, Sec. 5, Chung-Hsin Rd., Sanchung City, Taipei Hsien, Taiwan

[21] Appl. No.: 508,312

[22] Filed: Jul. 27, 1995

[51] Int. Cl.[6] ..... H01R 23/70

[52] U.S. Cl. ..... 439/637; 439/885

[58] Field of Search ..... 439/630–637, 439/60, 78, 540, 585, 851

[56] References Cited

U.S. PATENT DOCUMENTS

| | | | |
|---|---|---|---|
| 3,654,592 | 4/1972 | Primorac | 439/637 |
| 4,934,961 | 6/1990 | Piorunneck et al. | 439/637 |
| 5,041,023 | 8/1991 | Lytle | 439/637 |
| 5,277,607 | 1/1994 | Thumma et al. | 439/637 |

*Primary Examiner*—David L. Pirlot
*Attorney, Agent, or Firm*—Fish & Richardson P.C.

[57] ABSTRACT

An edge board connector includes a housing and two terminal pins each of which is formed from an elongated sheet metal and each of which has a back section and a curved movable section that are integrally formed with each other end to end. Each of the back sections abuts against the inner surface of a side wall of the housing and has an intermediate portion which is split to form a mounting leg that extends out from the housing. Each of the movable sections has a positioning part abutting against the middle wall unit of the housing, and a curved acting part having an intermediate portion which is split to form an elongated and arched clamping sheet that has two ends integrally formed with the remaining portion of the acting part and that extends into the card chamber in the housing at a middle portion thereof. The curved distal end portion of each of the acting parts abuts against the inner surface of the side wall of the housing so as to position the pins in the housing. A circuit card can be inserted into the card chamber and clamped between the clamping sheets of the connector.

2 Claims, 5 Drawing Sheets

EDGE BOARD CONNECTOR

BACKGROUND OF THE INVENTION

This invention relates to an edge board connector, more particularly to an edge board connector with improved terminal pins which have split portions and which can be easily manufactured at a lower cost.

FIGS. 1 and 2 show a first prior art connector which includes a housing 11 and two parallel rows of terminal pins 12, 13. The housing 11 has two parallel rows of terminal chambers 111, a card chamber 112 and two positioning strips 113. Each of the right pins 12 has a V-shaped clamping part 121, a back section 122 abutting against the inner surface of a side wall 100 of the housing 11, a mounting leg 123, and a positioning part 124 abutting against the right side of the right positioning strip 113. As best shown in FIG. 2, one of the mounting legs 123 of each adjacent pair of the right pins 12 is located in the outer side of the terminal chamber 111, while the other one is located in the intermediate portion of the terminal chamber 111 near the middle wall 120. Similarly, each of the left pins 13 has a V-shaped clamping part 131, a back section 132, a mounting leg 133 and a positioning part 134. The clamping parts 121, 131 of the pins 12, 13 easily fatigue, thereby causing poor electrical connection with the circuit card (not shown) inserted into the card chamber 112. Furthermore, the presence of the positioning strips 113 results in time-consuming injection molding of the housing 11.

FIG. 3 shows a second prior art connector which includes a housing 21 and two parallel rows of the terminal pins 22, 23. Unlike the first prior art connector, each of the pins 22, 23 has an end portion 221, 231 resting on the inner surface of the side wall so as to enhance the clamping action of the clamping parts 222, 232 of the pins 22, 23 toward the inserted circuit card (not shown). This connector is also provided with two positioning strips 213 which make the manufacture process of the housing 21 become inefficient. The pins 22, 23 are longer than the those of the first prior art connector, thereby increasing the manufacture costs. Furthermore, high precision is needed for this connector in manufacture due to the particular shape of the pins 22, 23.

FIG. 4 shows a third prior art connector in which no positioning strips are provided. However, the pins 32 are still too long.

SUMMARY OF THE INVENTION

An object of this invention is to provide an edge board connector with improved terminal pins each of which is formed from a short sheet metal and each of which can be easily positioned in the housing without necessity of positioning strips.

According to this invention, an edge board connector includes a housing and two terminal pins each of which is formed from an elongated sheet metal and each of which has a back section and a curved movable section that are integrally formed with each other end to end. Each of the back sections abuts against the inner surface of a side wall of the housing and has an intermediate portion which is split to form a mounting leg that extends out from the housing. Each of the movable sections has a positioning part abutting against the middle wall unit of the housing, and a curved acting part having an intermediate portion which is split to form an elongated and arched clamping sheet that has two ends integrally formed with the remaining portion of the acting part and that extends into the card chamber in the housing at a middle portion thereof. The curved distal end portion of each of the acting parts abuts against the inner surface of the side wall of the housing so as to position the pins in the housing. A circuit card can be inserted into the card chamber and clamped between the clamping sheets of the connector. In each of the pins, because the clamping sheet and the mounting leg are respectively split from the back section and the movable section of the pins, the sheet metal from which the pin is formed is short so as to reduce the manufacturing costs of the connector.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 2:
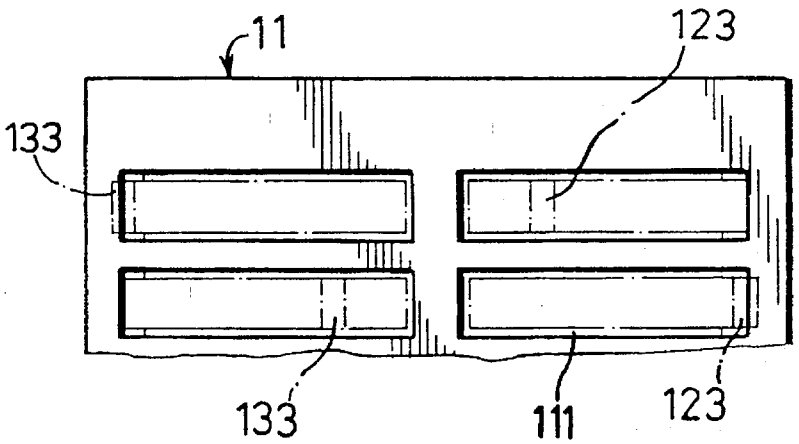
FIG. 2 PRIOR ART
FIG. 2 illustrates the positions of the mounting legs of the terminal pins of the first prior art connector.
Figure 1:
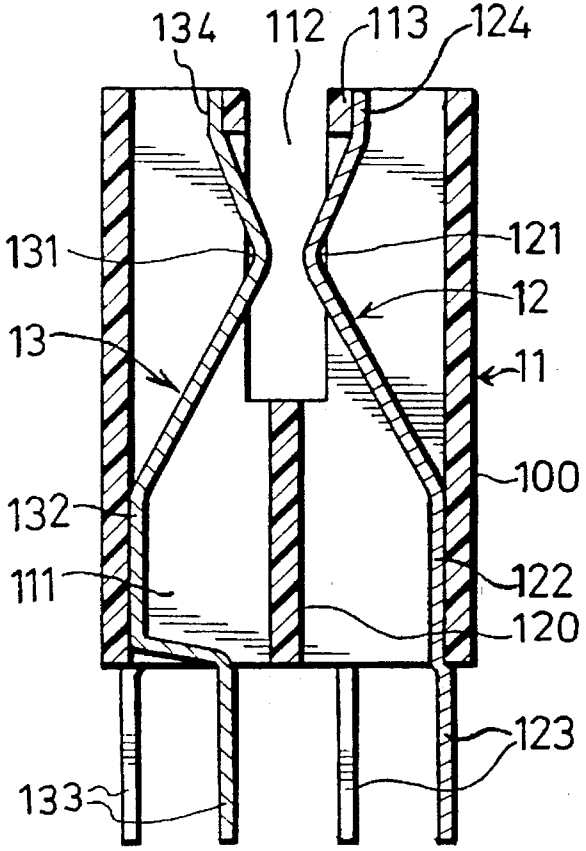
FIG. 1 PRIOR ART
FIG. 1 is a sectional view of a first prior art connector.
Figure 4:
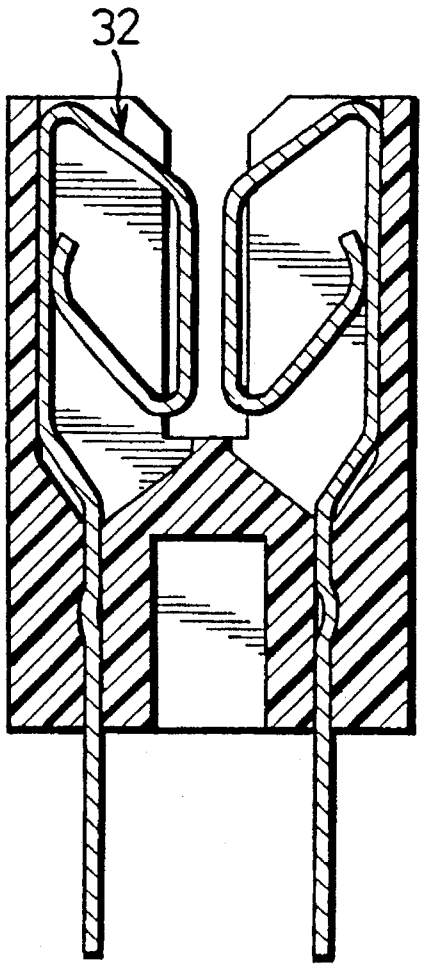
FIG. 4 PRIOR ART
FIG. 4 is a sectional view of a third prior art connector.
Figure 3:
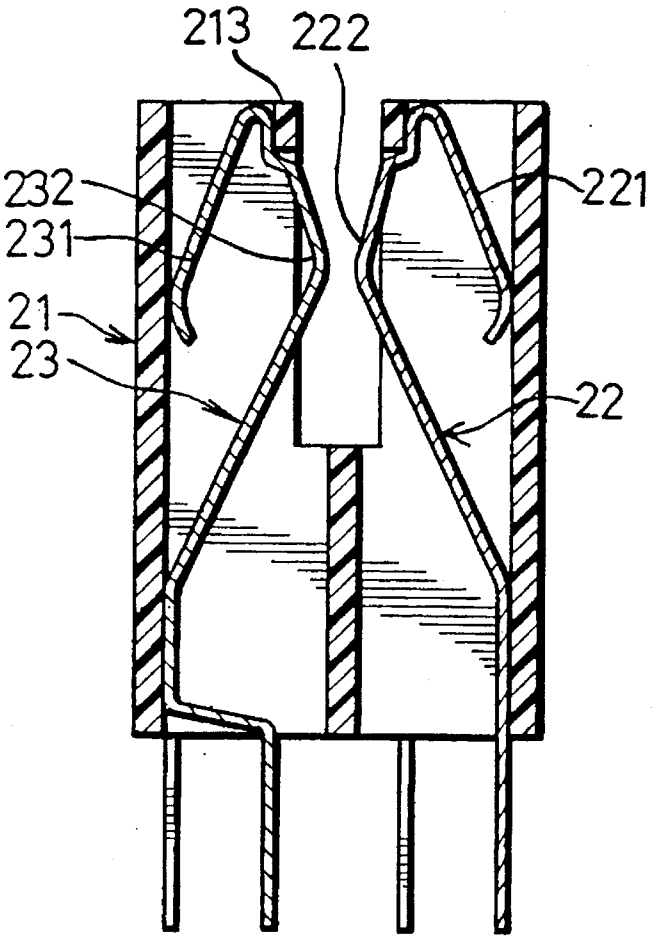
FIG. 3 PRIOR ART
FIG. 3 is a sectional view of a second prior art connector.
Figure 6:
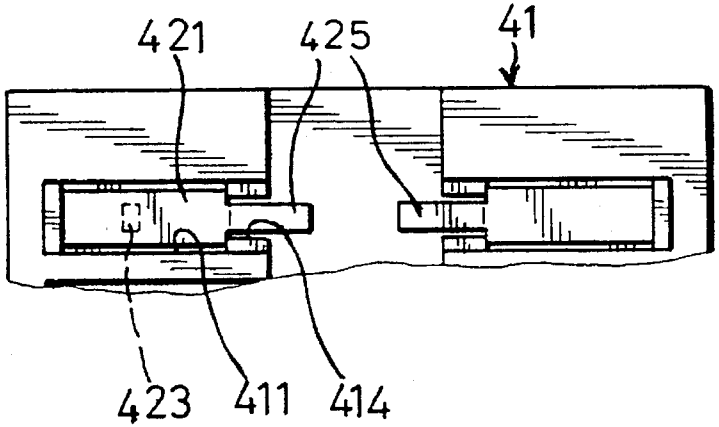
FIG. 6 illustrates the positions of the clamping sheets in the housing of the connector according to the first embodiment of this invention.
Figure 5:
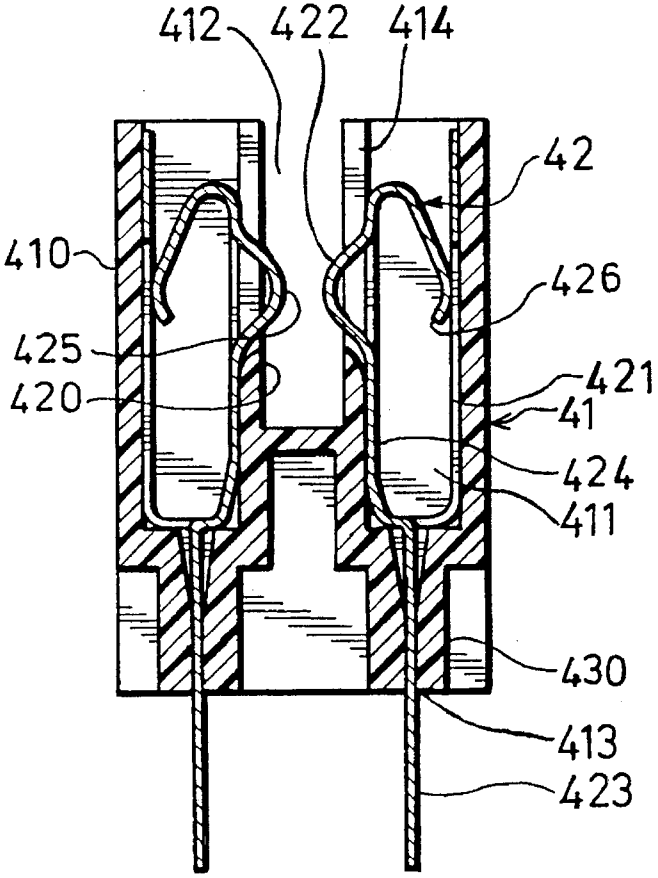
FIG. 5 is a sectional view of an edge board connector according to a first embodiment of this invention.

Referring to FIGS. 5 and 6, an edge board connector of this invention includes a housing 41 and two parallel rows of unitary terminal pins 42. The housing 41 has two opposite side walls 410, a middle wall unit 420 located between the side walls 410, two rows of terminal chambers 411 respectively receiving the pins 42 therein, and a card chamber 412 located over the middle wall unit 420 between the left row of terminal chambers 411 and the right row of terminal chambers 411. The middle wall unit 420 and the side walls 410 are interconnected by foot portions 430 with holes 413 formed therethrough. Each of the pins 42 is formed from an elongated high-ductility sheet metal shown in FIG. 7 and has a back section 421 abutting against the inner surface of the corresponding side wall 410, and a movable section 422 integrally formed with the back section 421. The back section 421 of each of the pins 42 has a split intermediate portion which is bent to form a vertical mounting leg 423 that extends out from the housing 41 through the corresponding hole 413 of the housing 41. Each of the pins 42 is confined in the terminal chamber 411 by two aligned vertical limiting posts 414 which are integrally formed with the middle wall unit 420 of the housing 41 and which are located between the terminal chamber 411 and the card chamber 412.

Figure 7:
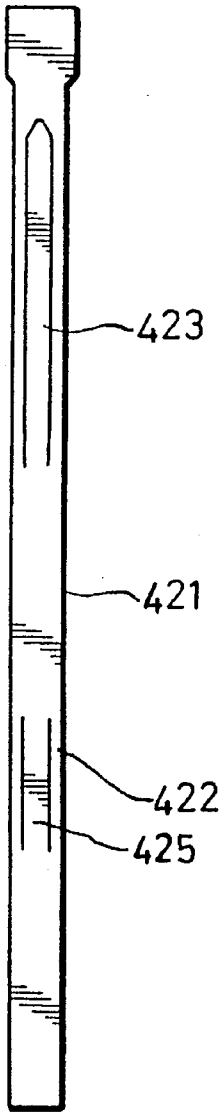
FIG. 7 illustrates a sheet metal from which the terminal pin of the connector according to the first embodiment of this invention is formed.

The movable section 422 of each of the pins 42 has a positioning part 424 abutting against the L-shaped portion of the middle wall unit 420, and a generally U-shaped acting part with an elongated and arched clamping sheet 425 which is split from an intermediate portion of the movable section 422 and which has a middle portion that extends into the card chamber 412. Any adjacent pair of limiting posts 414 are spaced apart from each other at a distance slightly greater than the width of the clamping sheets 425 so as to prevent the remaining portion of the movable section 422 of the corresponding pin 42 from moving into the corresponding card chamber 412, thereby positioning accurately the pin 42 in the corresponding terminal chamber 411. Each of the movable sections 422 has a generally V-shaped distal end portion 426 abutting against the inner surface of the corresponding side wall 410 so as to position the pin 42 within the corresponding terminal chamber 411 and so as to clamp a circuit card (not shown) between the clamping sheets 425 when the circuit card is inserted into the card chamber 412. When removed from the housing 41, any of the pins 42 can be folded into the form of FIG. 7 which is short so as to reduce the manufacture costs of the pin 42. As best shown in FIG. 7, the ends of each of the clamping sheets 425 are coupled with the remaining portion of the movable section 422.

Figure 8:
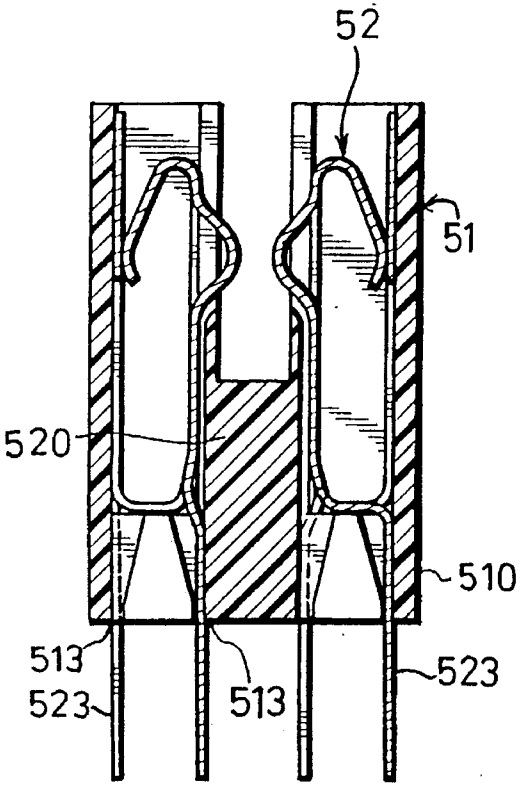
FIG. 8 is a sectional view of an edge board connector according to a second embodiment of this invention.

FIG. 8 shows another embodiment of this invention. Unlike the prior embodiment, the housing 51 and the pins 52 are somewhat modified in such a manner that one of the mounting legs 523 of each adjacent pair of the pins 52 of the same row abuts against the corresponding side wall 510, while the other one against a modified middle wall unit 520. The housing 51 has a plurality of holes 513 through which the mounting legs 523 extend.

Figure 9:
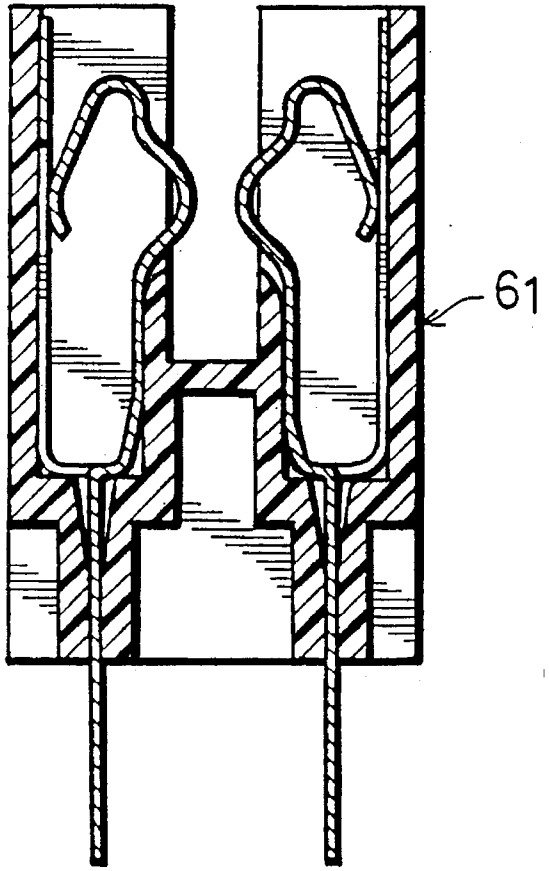
FIG. 9 is a sectional view of an edge board connector according to a third embodiment of this invention.

FIG. 9 shows a third embodiment of this invention which is similar to the first embodiment of FIGS. 5, 6 and 7 in construction except that there are no limiting posts provided on the housing 61 of this embodiment.

It can be appreciated that the pins can be easily positioned in the housing of the edge board connector in accordance with this invention.

Figure 10:
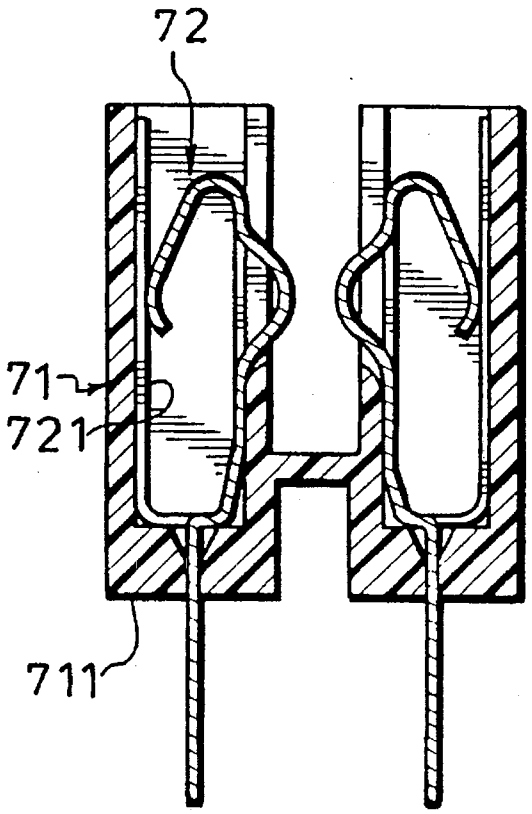
FIG. 10 is a sectional view of an edge board connector according to a fourth embodiment of this invention.

Because of easy position of the pins in the housing, the first embodiment of this invention can be modified into the construction shown in FIG. 10 in order to save the material of the connector, thereby reducing the manufacture costs. As illustrated, the back sections 721 of the pins 72 and the foot portions 711 of the housing 71 are shortened.

With this invention thus explained, it is apparent that numerous modifications and variations can be made without departing from the scope and spirit of this invention. It is therefore intended that this invention be limited only as indicated in the appended claims.

I claim:

1. An edge board connector comprising:

a housing having two opposite side walls, a middle wall unit positioned between said side walls, two terminal chambers formed in said housing between said side walls and located on two sides of said middle wall unit, and a card chamber formed in said housing between said terminal chambers near said middle wall unit and adapted to receive a circuit card in said card chamber; and two unitary terminal pins positioned within said terminal chambers respectively, each of said pins being formed from an elongated sheet metal and having a back section abutting against an inner surface of a corresponding one of said side walls, a mounting leg split from an intermediate portion of said back section and extending from said housing, and a curved movable section integrally formed with said back section, said movable section having a positioning part abutting against said middle wall unit, and a generally U-shaped acting part integrally formed with said positioning part end to end and having an intermediate portion which is split to form an elongated and arched clamping sheet that has two ends integrally formed with a remaining portion of said acting part and that extends into said card chamber at a middle portion of said clamping sheet, said acting part having a curved distal end portion abutting against the inner surface of the corresponding one of said side walls so as to position the middle portion of said clamping sheet in said card chamber, whereby, said circuit card can be clamped between said clamping sheets of said pins.

2. An edge board connector as claimed in claim 1, wherein said middle wall unit of said housing includes a plurality of pairs of aligned vertical limiting posts integrally formed therewith, each pair of said limiting posts being located between said card chamber and said corresponding terminal chamber and being spaced apart from each other at a distance slightly greater than width of said corresponding clamping sheet so as to confine said corresponding pin within said corresponding terminal chamber.

* * * * *